US006616024B1

(12) United States Patent
Perry

(10) Patent No.: US 6,616,024 B1
(45) Date of Patent: Sep. 9, 2003

(54) SUPPORT DEVICES FOR WOODWIND MUSICAL INSTRUMENT, AND METHODS OF MAKING THE SAME

(76) Inventor: Andrew M. Perry, 865 Fir Cove Dr., NE., Keizer, OR (US) 97303

( * ) Notice: Subject to any disclaimer, the term of this patent is extended or adjusted under 35 U.S.C. 154(b) by 0 days.

(21) Appl. No.: 10/023,253

(22) Filed: Dec. 17, 2001

Related U.S. Application Data

(63) Continuation-in-part of application No. 08/689,721, filed on Aug. 12, 1996, which is a continuation-in-part of application No. 29/151,699, filed on Nov. 6, 2001, now Pat. No. Des. 465,404.

(60) Provisional application No. 60/256,760, filed on Dec. 19, 2000.

(51) Int. Cl.[7] ..... G10G 5/00

(52) U.S. Cl. ..... 224/604; 84/453; 224/251; 224/910; 984/257

(58) Field of Search ..... 224/251, 250, 224/604, 605, 910, 258, 148.1, 148.4–148.7; 84/385 A, 387 A, 453, 470 R, 380 R, 380 C; 984/128, 139, 257; 24/3.4; D3/204

(56) References Cited

U.S. PATENT DOCUMENTS

| | | | | |
|---|---|---|---|---|
| 4,674,298 A | | 6/1987 | Wimmershoff-Caplan | 224/251 X |
| 4,841,829 A | | 6/1989 | Lehmann | 224/910 |
| 5,167,356 A | | 12/1992 | Williams | |
| 5,203,481 A | * | 4/1993 | Dobbins et al. | 224/148.4 |
| 5,246,154 A | | 9/1993 | Adams et al. | |
| 5,335,835 A | | 8/1994 | Hogan | |
| 5,586,704 A | | 12/1996 | Alexander et al. | |
| 5,622,292 A | | 4/1997 | Dorney | |
| 6,283,346 B1 | * | 9/2001 | Thomas | 224/148.6 |

FOREIGN PATENT DOCUMENTS

CA 957345 11/1974

* cited by examiner

*Primary Examiner*—Renee Luebke
(74) *Attorney, Agent, or Firm*—Marger Johnson & McCollom, P.C.

(57) ABSTRACT

Support devices for a woodwind musical instrument, and methods for making such support devices. A support device includes a strap for hanging from the neck of the user. Attached to the strap is a brace shaped to receive the instrument. This way the instrument is suspended from the neck of the user. Preferably the brace is such that the strap is attached so that no portion of the strap contacts the instrument, when it is so supported.

12 Claims, 4 Drawing Sheets

SUPPORT DEVICES FOR WOODWIND MUSICAL INSTRUMENT, AND METHODS OF MAKING THE SAME

CROSS REFERENCE TO RELATED APPLICATIONS

This is a continuation-in-part application from presently pending patent application Ser. No. 08/689,721, filed on Aug. 12, 1996, the disclosure of which is hereby incorporated by reference.

This application claims priority from U.S. Provisional Application No. 60/256,760 filed on Dec. 19, 2000, the disclosure of which is hereby incorporated by reference.

This is a continuation-in-part application from co-pending U.S. Design patent application Ser. No. 29/151,699, filed on Nov. 6, 2001, now U.S. Des. Pat. No. D465,404 S, the disclosure of which is hereby incorporated by reference.

BACKGROUND OF THE INVENTION

1. Field of the Invention

The present invention is related to the field of implements for musical instruments.

2. Description of the Related Art

A recorder is a woodwind musical instrument that is very suitable for instructing children in music. A child will typically take a recorder to class, and hold it with both hands during instruction. Experience has shown, however, that in the hands of a child, a recorder may become a toy, a weapon, or whatever fits the occasion.

If the child needs to use the hands for another purpose, the recorder will be placed down. When that happens, the recorder may be lost, mixed up with other ones, or placed in an unsanitary condition.

Some resourceful teachers have addressed this by tying a string around the recorder, and then passing the string around the child's neck. When that is done for many children, the teachers' attention is spent away from teaching, wasting a lot of precious instruction time.

BRIEF SUMMARY OF THE INVENTION

The present invention overcomes these problems and limitations of the prior art.

Generally, the present invention provides support devices for a musical instrument, and methods for making such support devices. A support device includes a strap for hanging from the neck of the user. Attached to the strap is a brace, shaped to receive the instrument.

This way the instrument cannot be placed down. When released, it will hang from the neck of the user, preventing losing it. In addition, the strap limits how far from the user the instrument can be moved, when there is a pause in musical instruction.

Preferably the brace is such that the strap is attached such that no portion of the strap contacts the instrument, when it is so supported. This optimizes the contact of the instrument with the brace.

The invention will become more readily apparent from the following Detailed Description, which proceeds with reference to the drawings, in which:

DETAILED DESCRIPTION OF THE PREFERRED EMBODIMENT(S)

As has been mentioned, the present invention provides a support device that may be hung around the neck of the user. The support device includes a strap for looping around the neck, and a brace shaped to receive the instrument. The brace is attached to the strap, preferably without any portion of the strap contacting the instrument. The invention is now described in more detail.

Figure 1:
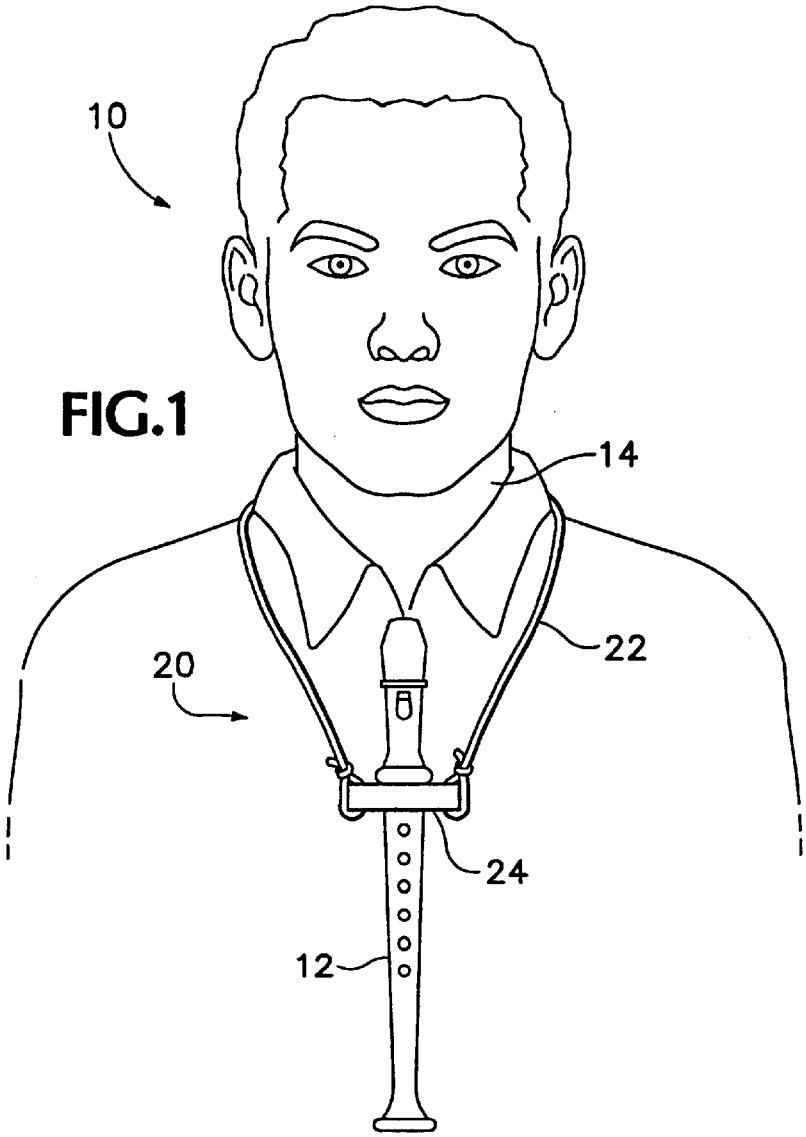
FIG. 1 is a frontal view of a user supporting a woodwind instrument on his neck using a support device made according to embodiments of the present invention.

FIG. 1 is a frontal view of a user 10 supporting a woodwind musical instrument 12 on his neck 14 using a support device 20 made according to embodiments of the present invention. Woodwind musical instrument 12 can be a recorder, clarinet, oboe, etc.

Support device 20 includes a flexible strap 22 that is looped around the user's neck 14. In addition, support device 20 includes a brace 24 that supports instrument 12. Brace 24 is attached to strap 22.

Figure 2:
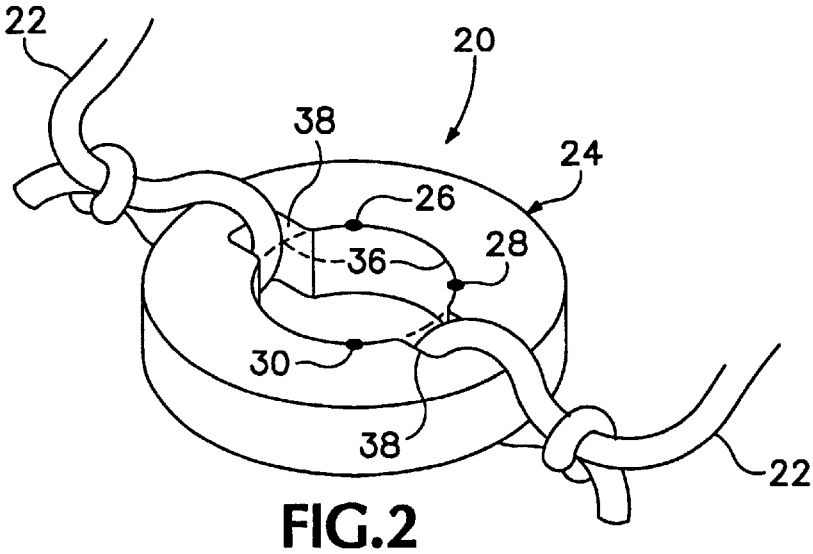
FIG. 2 is a perspective view of the support device of FIG. 1, made according to a general embodiment of the invention.

FIG. 2 is a perspective view of support device 20. As mentioned above, its main two components are strap 22 and brace 24.

Strap 22 can be made to be flexible, so as to permit looping around the user's neck 14. Strap 22 can be from a ribbon, chain, etc., made from materials like rope, plastic rope, cloth, leather, plastic, rubber, etc.

Brace 24 is intended to support the musical instrument. Accordingly, brace 24 can be made from any suitable resilient material, such as plastic, wood, or metal.

Brace 24 forms a closed loop, which presents at least three inside contact points 26, 28, 30. Points 26, 28, 30 are understood as points in the geometrical sense, which are infinitesimally small.

The three inside contact points 26, 28, 30 delineate a support circle 36 for receiving the instrument therein. When the instrument is placed therein, it will contact at a minimum all three inside contact points 26, 28, 30, and its circumference will coincide with support circle 36.

The diameter of support circle 36 is determined from a size of the musical instrument. This inside diameter should be a little larger than the diameter at the thinnest point of the piece of the intended instrument, to which the brace is brought into contact when used, especially if the latter is of the type that can be disconnected into two pieces, and then be reconnected.

The closed loop present an internal surface, whose shape may be cylindrical at least in part. In another embodiment of the invention, such as shown in FIG. 5A, the internal surface 56A is tapered, to provide better contact with the instrument. By tapered, it is meant that its diameter changes gradually and monotonically in planes taken perpendicularly along a long axis of the supported instrument.

Brace 24 further forms tying sections 38. It is preferred but not necessary that tying sections 38 be opposite each other on brace 24. This way instrument 12 in FIG. 1 will be suspended straight down.

The ends of strap 22 are tied around tying sections 38. It will be noted that, after being tied, strap 22 does not intrude in support circle 36, as is preferred.

It will be further noted that support circle 36 is abstract. Parts of it may be missing, and actual support may thus not be provided in its full perimeter.

More particularly, support circle 36 has a first part perimeter, which makes contact with the instrument when suspended. In the embodiment of FIG. 2, the first part perimeter of circle 36 is made from two portions shown in solid lines as part of brace 24. Inside contact points 26, 28, 30 can be taken to be any three points of the first part perimeter.

Moreover, support circle 36 has a second part perimeter, which does not make contact with the instrument when suspended. In the embodiment of FIG. 2, the second part perimeter of circle 36 is made from two sections shown in dashed lines. The second part perimeter corresponds to tying sections 38 of brace 24.

It will be observed that, in the embodiment of FIG. 2, sections of strap 22 intrude in the closed loop of brace 24, but no section of strap 22 intrudes in support circle 36. However, the full closed loop of brace 24 leaves gaps in circle 36, not allowing for full support.

Figure 3:
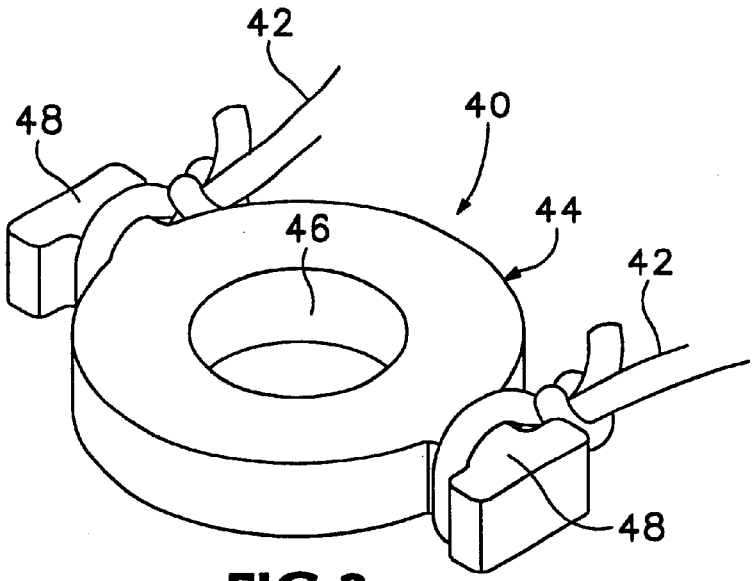
FIG. 3 is a perspective view of a support device made according to a more preferred embodiment of the invention.

FIG. 3 is a perspective view of another support device 40, which is made according to a more preferred embodiment of the invention. Device 40 includes a strap 42 and a brace 44. Brace 44 forms a closed loop, which has a receiving opening 46 for receiving therein the instrument.

Preferably, a section of receiving opening 46 is circular. In that case, the above mentioned three inside contact points can be any points in the inside circumference such a circle. This way receiving opening 46 provides fuller support of the instrument, which is why embodiment 40 is more preferred than embodiment 20.

What was described above for the size of support circle 36 and shape of the internal surface of the closed loop of brace 24 may also apply for receiving opening 46 and its internal surface. In other words, receiving opening 46 may be sized for the instrument. Its internal surface may be cylindrical or tapered, etc.

Brace 44 also has tying sections 48, which are outside the closed loop of brace 44. The ends of strap 42 are tied around tying sections 48. It will be noted that, this way, strap 42 therefore does not intrude in the closed loop, and thus it also does not intrude in the inside circumference of receiving opening 46.

Figure 4:
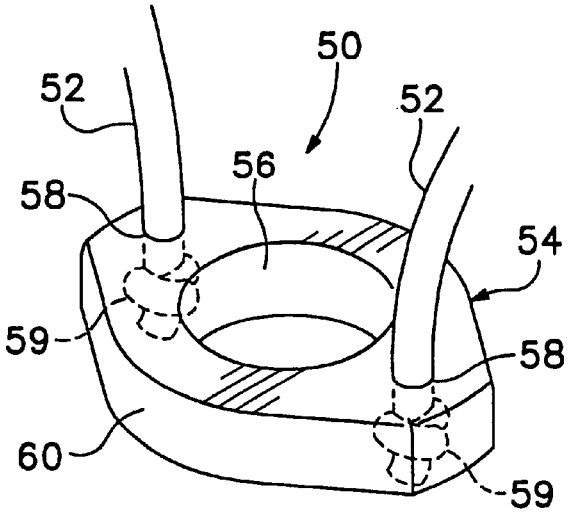
FIG. 4 is a perspective view of a support device made according to an even more preferred embodiment of the invention.

FIG. 4 is a perspective view of support device 50, made according to an even more preferred embodiment of the invention. Device 50 includes a strap 52 and brace 54.

Brace 54 forms a closed loop for receiving the musical instrument. The closed loop defines a receiving opening 56 for receiving the musical instrument.

What was described above for the size of receiving opening 46 and shape of its internal surface may also apply for receiving opening 56. In other words, receiving opening 56 may be sized for the instrument. Its internal surface may be cylindrical or tapered, etc.

In brace 54, the two tying sections are formed by two tying openings 58. The two ends of strap 52 are passed through tying openings 58, without any portion of the strap intruding in the closed loop, or in receiving opening 56. Then the ends are enlarged, to prevent them from being withdrawn from the tying opening. Once enlarged, the ends present a larger diameter than that of tying openings 58, and thus cannot slip out. Other than that, the ends need not be tied onto any particular portion of brace 54.

Enlarging can be in any number of ways. One such way is to tie each end of strap 52 in a knot 59 upon itself. Another way is to heat the end.

In the embodiment of FIG. 4, brace 54 also has a skirt 60 transverse to the plane of tying openings 58, to obscure the view of the unsightly knots. Indeed, one of knots 59 is not visible in FIG. 4, because its view is obstructed by skirt 60.

Figure 5:
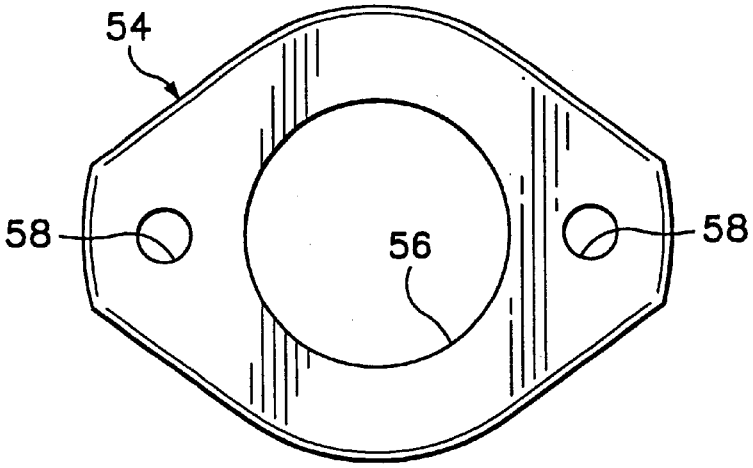
FIG. 5A is a cutaway front view of the brace of FIG. 5, showing a tapered internal surface according to another embodiment of the invention.
Figure 5A:
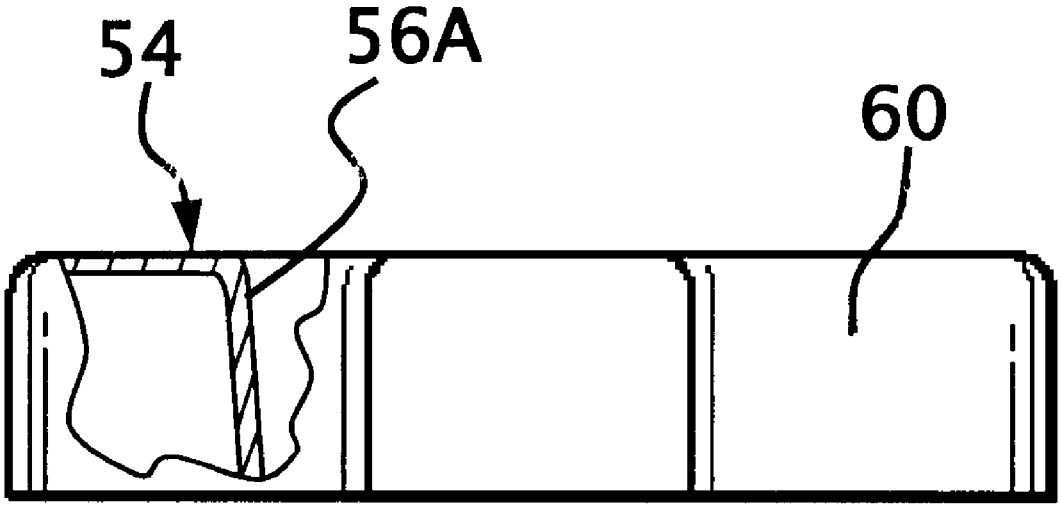
Figure 6:
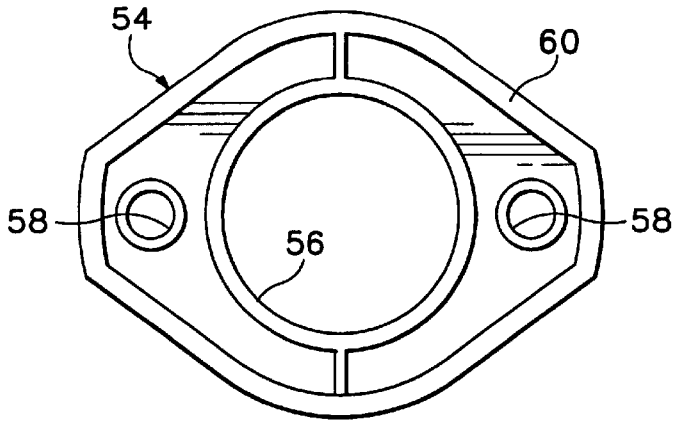
FIG. 6 is a bottom view of the brace of FIG. 4.
Figure 7:
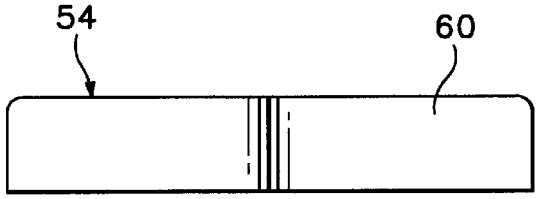
FIG. 7 is a side view of the brace of FIG. 4.
Figure 8:
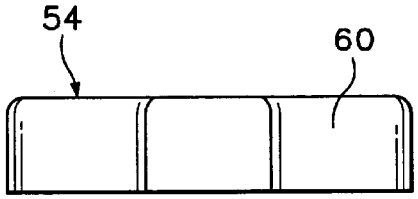
FIG. 8 is a front view of the brace of FIG. 4.

Brace 54 is also shown in FIGS. 5–8. FIG. 5 is a top view, and FIG. 6 is a bottom view. FIG. 7 is a side view, and FIG. 8 is a front view.

In addition, in FIG. 5 and FIG. 6, the plane of the drawing is the same as the plane of tying openings 58, and skirt 60 is perpendicular to that plane. The long axis of the suspended instrument is perpendicular to the page.

Figure 9:
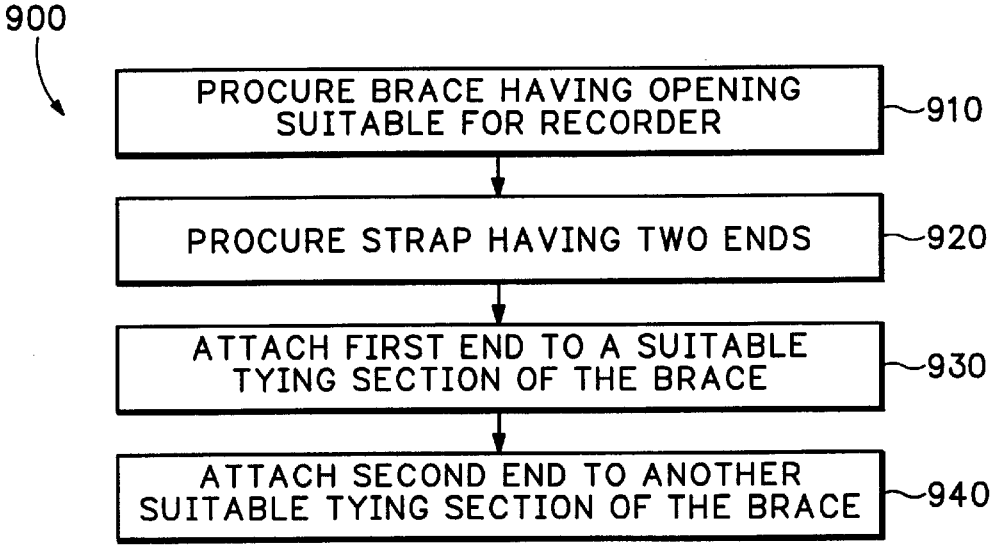
FIG. 9 is a flowchart illustrating a method of making a support device according to an embodiment of the present invention.

Referring now to FIG. 9, a flowchart 900 is used to illustrate a method according to an embodiment of the invention. The method of flowchart 900 may also be practiced by any person and/or machine assembling a support device.

According to a box 910, a brace is procured that has a receiving opening suitable for receiving a woodwind musical instrument. More particularly, the procured brace forms a closed loop which presents at least three inside contact points. The inside contact points delineate a support circle suitable for receiving the instrument therein. In addition, the procured brace has two tying sections.

According to a next box 920, a strap is procured having two ends.

According to a next box 930, a first end of the strap is attached to a tying section of the brace. Attaching is performed such that no section of the strap intrudes in the support circle.

Attaching may be performed by tying the first end around the tying section of the brace. Alternately, the tying section maybe a tying opening, in which case attaching includes passing the first end of the strap through the tying opening, and then enlarging it, to prevent it from being withdrawn from the tying opening. Enlarging can be by tying a knot of the strap upon itself. If the strap is made from plastic rope, then enlarging can be by heating. In addition, burning the first end will fuse it, which will prevent fraying.

According to an optional next box 940, a second end of the strap is attached to another tying section of the brace. Attaching is performed such that no section of the strap intrudes in the support circle.

Attaching may be performed by tying the second end around the other tying section of the brace. Alternately, the other suitable portion may be a second tying opening, in which case attaching includes passing the second end of the strap through the second tying opening, and then enlarging it, to prevent it from being withdrawn from the tying opening. Enlarging can be by tying a knot of the strap upon itself. If the strap is made from plastic rope, then enlarging can be by heating. In addition, burning the second end will fuse it, which will prevent fraying.

Referring back to FIG. 1, use of device 20 is described in more detail. User 10 loops strap 22 around their neck 14, letting brace 24 be suspended on their front side. Then instrument 12 is placed in the closed loop of brace 24, or the support circle, as the case may be. Instrument 12 may optionally be moved with respect to brace 24 until it is lodged. Then instrument 12 is released, so that it will hang from neck 14. These steps may take place in any order.

The instrument may be placed in the brace through its distal end. Alternately, the instrument is disconnected into two pieces. One of the pieces is passed through the closed loop of the brace, or the support circle, as the case may be. Then the pieces are reconnected.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments as disclosed and illustrated herein are not to be considered in a limiting sense. Indeed, it should be readily apparent to those skilled in the art in view of the present description that the invention may be modified in numerous ways. The inventor regards the subject matter of the invention to include all combinations and subcombinations of the various elements, features, functions and/or properties disclosed herein.

The following claims define certain combinations and subcombinations, which are regarded as novel and non-obvious. Additional claims for other combinations and subcombinations of features, functions, elements and/or properties may be presented in this or a related document.

The invention claimed is:

1. A combination comprising:

a woodwind musical instrument comprising a shaft; and a device for supporting the woodwind musical instrument on a neck of a user, wherein the device comprises:

a strap for looping around the neck; and a brace forming a closed loop that presents at least three inside contact points, the three inside contact points delineating a support circle for contacting the shaft and supporting the woodwind musical instrument, the brace further comprising at least two distinct connection sections, wherein ends of the strap are connected to the connection sections without any portions of the strap intruding into the support circle.

2. The device of claim 1, wherein the connection sections are formed opposite each other on the brace.

3. The device of claim 2, wherein ends of the strap are tied around the connection sections.

4. The device of claim 1, in which the closed loop presents an internal surface that is tapered to match an upwardly expanding diameter of the woodwind musical instrument.

5. The device of claim 4, wherein the tapered internal surface supports the woodwind musical instrument.

6. A device for supporting a woodwind musical instrument on a user, comprising:

a strap for looping around a neck of the user; and a brace forming a closed loop for receiving the instrument therein, the brace further forming two openings distinct from each other, in which ends of the strap are passed through the openings and prevented from exiting therefrom, without any portion of the strap intruding in the closed loop, wherein the closed loop comprises an internal surface that is tapered to match an upwardly expanding diameter of a shaft of the woodwind musical instrument.

7. The device of claim 6, wherein the tapered internal surface supports the woodwind musical instrument.

8. The device of claim 6, in which the brace is shaped such that the internal surface of the closed loop is cylindrical and provides multiple contact points for contacting the shaft and supporting the woodwind musical instrument.

9. The device of claim 6, in which the brace further includes a skirt transverse to a plane of the openings.

10. The device of claim 9, further comprising ribs extending between the skirt and the closed loop.

11. The device of claim 6, in which the woodwind musical instrument is a recorder.

12. The device of claim 11, in which the recorder is a two-piece recorder being separable at a separation point along the shaft thereof, and wherein the shaft of the two-piece recorder gradually increases in diameter from the separation point to a mouth piece end.

* * * * *

UNITED STATES PATENT AND TRADEMARK OFFICE

CERTIFICATE OF CORRECTION

PATENT NO. : 6,616,024 B1
DATED : September 9, 2003
INVENTOR(S) : Perry

It is certified that error appears in the above-identified patent and that said Letters Patent is hereby corrected as shown below:

Column 2,
Line 8, missing text for FIG. 5, between text for FIG. 4 and FIG. 5A, should read -- FIG. 5 is a top view of a brace of the support device of FIG. 4. --.
Line 65, "loop present an" should read -- loop presents an --.

Signed and Sealed this

Sixth Day of April, 2004

JON W. DUDAS
*Acting Director of the United States Patent and Trademark Office*